US011149969B2

(12) United States Patent
Brand et al.

(10) Patent No.: US 11,149,969 B2
(45) Date of Patent: Oct. 19, 2021

(54) CONTROLLED LOW HUMIDITY STORAGE DEVICE AND METHODS

(71) Applicant: Andersen Corporation, Bayport, MN (US)

(72) Inventors: Philip Brand, New Richmond, WI (US); Scott Thom, White Bear Township, MN (US); Kevin Alex Nelson, Woodbury, MN (US); Mitchell Hunt, Hugo, MN (US)

(73) Assignee: Andersen Corporation, Bayport, MN (US)

( * ) Notice: Subject to any disclaimer, the term of this patent is extended or adjusted under 35 U.S.C. 154(b) by 135 days.

(21) Appl. No.: 16/280,206

(22) Filed: Feb. 20, 2019

(65) Prior Publication Data

US 2019/0264930 A1 Aug. 29, 2019

Related U.S. Application Data

(60) Provisional application No. 62/634,339, filed on Feb. 23, 2018.

(51) Int. Cl.
*F24F 3/14* (2006.01)
*F24F 13/32* (2006.01)
(Continued)

(52) U.S. Cl.
CPC ..... *F24F 3/14* (2013.01); *F24F 7/013* (2013.01); *F24F 11/72* (2018.01); *F24F 13/06* (2013.01);
(Continued)

(58) Field of Classification Search
CPC .... F24F 3/14; F24F 13/32; F24F 11/72; F24F 7/013; F24F 13/06; F24F 13/085; F24F 2003/144
See application file for complete search history.

(56) References Cited

U.S. PATENT DOCUMENTS 5,332,547 A 7/1994 Olson et al.
6,387,332 B1 * 5/2002 Dickinson ..... A61L 2/20 324/314

(Continued)

FOREIGN PATENT DOCUMENTS

JP 2002274608 9/2002

*Primary Examiner* — Kun Kai Ma
(74) *Attorney, Agent, or Firm* — Pauly, DeVries Smith & Deffner LLC

(57) ABSTRACT

Embodiments herein relate to controlled low humidity storage devices and related methods. In an embodiment, the device can include a housing defining a storage compartment and an access aperture with a door. The device can include a dry gas supply system in fluid communication with the storage compartment configured to deliver low humidity gas to the storage compartment. The device can also include a control unit in electrical communication with the dry gas supply system. The device can also include a pressure sensor configured to measure a pressure differential between the inside of the storage compartment and the ambient environment, the pressure sensor in electronic communication with the control unit. The control unit can be configured to initiate delivery of low humidity gas from the dry gas supply system in response to a signal received from the pressure sensor. Other embodiments are also included herein.

17 Claims, 13 Drawing Sheets

(51) Int. Cl.

| | |
|---|---|
| ***F24F 11/72*** | (2018.01) |
| ***F24F 7/013*** | (2006.01) |
| ***F24F 13/06*** | (2006.01) |
| ***F24F 13/08*** | (2006.01) |

(52) U.S. Cl.
CPC ..... *F24F 13/085* (2013.01); *F24F 13/32* (2013.01); *F24F 2003/144* (2013.01)

(56) References Cited

U.S. PATENT DOCUMENTS

| | | | | |
|---|---|---|---|---|
| 2009/0090022 | A1* | 4/2009 | Ho | F26B 21/14 34/406 |
| 2011/0286908 | A1* | 11/2011 | Matsuuchi | B01J 19/126 423/400 |
| 2013/0111939 | A1* | 5/2013 | Yan | H01M 10/482 62/282 |
| 2015/0226481 | A1* | 8/2015 | Marchiori | F26B 25/16 34/412 |
| 2017/0059442 | A1* | 3/2017 | Mcclanahan | G01M 3/3272 |
| 2020/0188860 | A1* | 6/2020 | Paul | B01D 67/0011 |

* cited by examiner

CONTROLLED LOW HUMIDITY STORAGE DEVICE AND METHODS

This application claims the benefit of U.S. Provisional Application No. 62/634,339, filed Feb. 23, 2018, the content of which is herein incorporated by reference in its entirety.

FIELD

Embodiments herein relate to controlled low humidity storage devices and related methods.

BACKGROUND

Many different types of materials can benefit from storage in a low humidity environment. For example, moisture can contribute to the degradation and/or failure of electronic components, biologic materials, pharmaceuticals, chemical reagents, building materials, and the like. In many cases, moisture transferred to a material can include moisture absorbed from the air in contact with the material. Therefore, in scenarios where moisture may be harmful, it is important to consider and try to reduce the humidity of the air in contact with the materials.

SUMMARY

Embodiments herein relate to controlled low humidity storage devices and related methods. In an embodiment, a controlled low humidity storage device. The device can include a housing defining a storage compartment and an access aperture. The device can also include a door attached to the housing configured to selectively open to allow access to the storage compartment through the access aperture and close to seal the access aperture. The device can include a dry gas supply system in fluid communication with the storage compartment configured to deliver low humidity gas to the storage compartment. The device can also include a control unit in electrical communication with the dry gas supply system. The device can also include a pressure sensor configured to measure a pressure differential between the inside of the storage compartment and the ambient environment, the pressure sensor in electronic communication with the control unit. The control unit can be configured to initiate delivery of low humidity gas from the dry gas supply system in response to a signal received from the pressure sensor.

In an embodiment, a method of assembling insulating glazing units is included. The method can include placing a first portion of a spacer between two sheets of a transparent material. The method can also include placing a remaining portion of the spacer into a low humidity storage device. The method can also include removing moisture from the controlled low humidity storage device. The method can also include removing the remaining portion of the spacer from the controlled low humidity storage device. The method can also include placing the remaining portion of the spacer between two sheets of a transparent material.

In an embodiment, a controlled low humidity storage device is included herein. The controlled low humidity storage device can include a housing defining a storage compartment and an access aperture. The controlled low humidity storage device can also include a door attached to the housing configured to selectively open to allow access to the storage compartment through the access aperture and close to seal the access aperture. The controlled low humidity storage device can also include a dry gas supply system in fluid communication with the storage compartment configured to deliver low humidity gas to the storage compartment. The controlled low humidity storage device can also include a control unit in electrical communication with the dry gas supply system. The controlled low humidity storage device can also include a door sensor in electrical communication with the control unit, the door sensor configured to detect opening and closing of the door. The control unit can be configured to initiate delivery of low humidity gas from the dry gas supply system in response to a signal received from the door sensor.

In an embodiment, a controlled low humidity storage device is included herein. The controlled low humidity storage device can include a housing defining a storage compartment and an access aperture. The controlled low humidity storage device can include a door attached to the housing configured to selectively open to allow access to the storage compartment through the access aperture and close to seal the access aperture. The controlled low humidity storage device can include a dry gas supply system in fluid communication with the storage compartment configured to deliver low humidity gas to the storage compartment. The controlled low humidity storage device can include a control unit in electrical communication with the dry gas supply system. The controlled low humidity storage device can include a pressure sensor configured to measure a pressure differential between the inside of the storage compartment and the ambient environment, the pressure sensor in electronic communication with the control unit. The control unit can be configured to operate in a door opening event mode and a maintenance operating mode. The control unit can operate in the door opening event mode it causes the dry gas supply to deliver low humidity gas to in an amount sufficient to raise the pressure within the storage compartment to at least 1 inch of water greater than the pressure of the ambient environment in response to a detected door opening event, then continue delivering low humidity gas for a predefined period of time, and then cease delivering low humidity gas. The control unit can operate in the maintenance operating mode and can monitors signals from the pressure sensor to detect when the pressure within the storage compartment falls to within 0 to 0.1 inch of water greater than the pressure of the ambient environment and thereafter causes the dry gas supply to deliver low humidity gas to in an amount sufficient to raise the pressure within the storage compartment to at least 1 inch of water greater than the pressure of the ambient environment.

While embodiments are susceptible to various modifications and alternative forms, specifics thereof have been shown by way of example and drawings, and will be described in detail. It should be understood, however, that the scope herein is not limited to the particular embodiments described. On the contrary, the intention is to cover modifications, equivalents, and alternatives falling within the spirit and scope herein.

BRIEF DESCRIPTION OF THE FIGURES

Aspects may be more completely understood in connection with the following drawings, in which.

Figure 1:
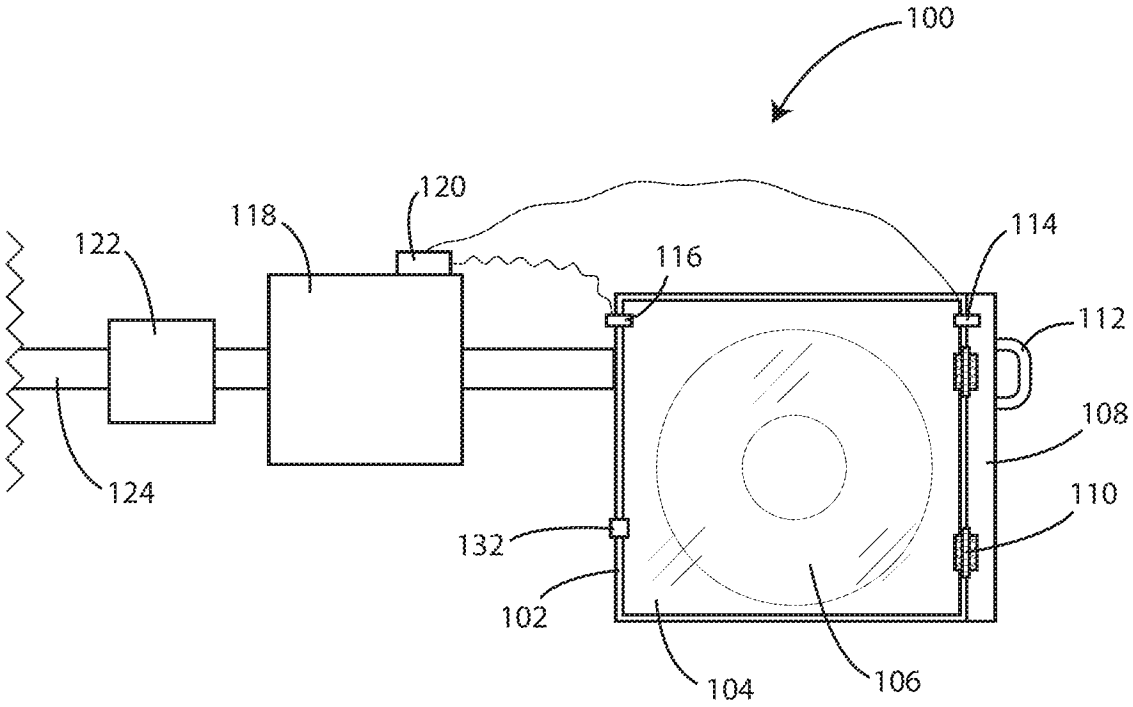
FIG. 1 is a schematic view of a low humidity storage device in accordance with various embodiments herein.

While embodiments are susceptible to various modifications and alternative forms, specifics thereof have been shown by way of example and drawings, and will be described in detail. It should be understood, however, that the scope herein is not limited to the particular embodiments described. On the contrary, the intention is to cover modifications, equivalents, and alternatives falling within the spirit and scope herein.

DETAILED DESCRIPTION

As referenced above, many different types of materials can benefit from storage in a low humidity environment. One category of such materials are building materials and/or components used to create building materials. A particular challenge arises when the item to be stored is itself designed to absorb moisture.

Insulating glazing units (IGUs) are a typical subcomponent of a fenestration unit, such as a window or a door. As described below with reference to FIG. 10, IGUs are frequently assembled with a window spacer assembly. A particular type of window spacer assembly can be referred to as a flexible insulating glass spacer. Flexible insulating glass spacers have a portion of their volume dedicated to moisture absorption through the incorporation of a desiccant material. This desiccant makes the long-term performance of the IGU partially dependent on the spacer system staying appropriately dry during manufacturing.

However, if the window spacer assembly is in typical manufacturing ambient environments for a significant amount of time, it can absorb moisture and compromise the long-term quality of the material. It is common in IGU fabrication for rolls of window spacer to be stored for many days in between use. One reason for this is that spacers come in multiple thicknesses, therefore the volume of spacer necessary to produce certain glass constructions will vary depending on the build volume. Generally, it is highly unlikely that builds will use full length rolls of spacer material, requiring that the spacer material be stored until its specific width is needed again by production.

Typically, if the window spacer assembly is not used quickly and needs to be stored for some amount of time, it has been recommended to simply repackage partially used reels of window spacers in the original packaging materials, such as a MYLAR bag. However, as shown in the example below, ambient moisture can still get into the MYLAR bag and begin to saturate the desiccant in the spacer.

Simply using a desiccant material in a storage bag or storage box to control the humidity that the window spacer is exposed to would be problematic because the desiccant in the window spacer would then compete with the humidity control desiccant, reducing its effectiveness. In addition, the desiccating properties of the material to be stored interferes with the use of a simple hygrometer to measure and control humidity within a container. It is believed that hygrometer based humidity measurements may be of limited value in the presence of a strong desiccating material, since the desiccating material may lower the humidity by absorbing moisture, possibly becoming saturated, thereby becoming less effective, even though the hygrometer shows the humidity to be low. As a result, the hygrometer reading can be a misleading indicator of the true condition of the desiccating material.

Embodiments herein include low humidity storage devices that accommodate the storage of materials that benefit from low humidity storage and that use one or more pressure sensors to help maintain low humidity conditions therein. In some embodiments, compressed air goes through coalescing filters, which removes fine contaminants, oil vapor, and moisture, then goes through a hollow fiber membrane, further drying the air to close to zero moisture content and this dried air is used to purge the storage compartment of the storage device. The storage compartment is sealed other than purposeful leakage out of the storage compartment to control pressure and allow the purge of humid air out of the storage compartment. In some embodiments, a door switch can be included that shuts off airflow during loading and unloading of the storage compartment.

In some embodiments, after placing the spacer into the box and closing the door, an air exchange process starts. The low humidity storage device can be set on a timer to purge the storage compartment for a predefined period of time (such as 20 minutes in one example) after the door has been opened and closed to get the internal humidity down to 0% to 10%. There can also be a periodic purge of dry air into the storage compartment to maintain positive pressure inside the storage compartment so as to maintain the desired humidity level. As long as the storage compartment maintains a slightly positive pressure in the interior of the storage compartment, this prevents further moisture ingression into the storage compartment, so the optimal level of humidity can be maintained essentially indefinitely (as long as the purge air is sufficiently dry) to allow flexibility in storage and longer shelf life of the flexible spacer (or other moisture sensitive materials). This can be accomplished by using a pressure transducer (sensor) connected to a control unit, which re-pressurizes the storage compartment anytime the pressure reading falls below the desired level. In some embodiments, a hygrometer can be used in addition to a pressure sensor. However, as noted above, it is believed that hygrometer based humidity measurements can frequently be inaccurate in the presence of a strong desiccating material.

Referring now to FIG. 1, a schematic view of a low humidity storage device 100 is shown in accordance with various embodiments herein. The low humidity storage device 100 can include a housing 102 defining a storage compartment 104 and an access aperture (shown in FIG. 2). The low humidity storage device 100 can include a door 108 attached to the housing. The door 108 can be attached through the use of hinges 110 or another type of mechanical connection.

The door 108 can be configured to selectively open to allow access to the storage compartment 104 through the access aperture and close to seal the access aperture. In some embodiments, the door 108 can include a handle 112 to facilitate its opening and closing. The low humidity storage device 100 can include a dry gas supply system 118 in fluid communication with the storage compartment configured to deliver low humidity gas to the storage compartment. In some embodiments, a mechanism can be used to bias the door 108 into a closed position, such as a spring-loaded hinge or a similar mechanism.

The low humidity storage device 100 can include a control unit 120 in electrical communication with the dry gas supply system 118. The low humidity storage device 100 can include a pressure sensor 116 configured to measure a pressure differential between the inside of the storage compartment 104 and the ambient environment. The pressure sensor 116 can be in electronic communication with the control unit 120. The control unit 120 can be configured to initiate delivery of low humidity gas from the dry gas supply system 118 in response to a signal received from the pressure sensor 116.

The controlled low humidity storage device 100 can also include a prefilter 122 to receive compressed gas, remove contaminants therefrom, and supply filtered gas to the dry gas supply system 118. In some embodiments, multiple prefilters can be used in series. The prefilter 122 can be in fluid communication with a compressed air (or plant air) source 124.

In some embodiments, the controlled low humidity storage device 100 can include a door sensor 114 in electrical communication with the control unit 120. The door sensor 114 can be configured to detect opening and closing of the door 108. In some embodiments, the controlled low humidity storage device 100 can be configured to cause gas flow to cease when the door sensor 114 detects opening of the door 108. The door sensor 114 can be an optical, capacitive, or electrical switch. In some embodiments, the control unit 120 can be configured to trigger the dry gas supply system 118 to deliver a low humidity gas in response to a signal from the door sensor 114.

The storage compartment 104 can be of various sizes. In some embodiments the storage compartment can have a volume of about 0.2 $ft^3$ to about 120 $ft^3$. In some embodiments the storage compartment can have a volume of about 0.5 $ft^3$ to about 20 $ft^3$. Various items or materials can be stored within the storage compartment 104. In some embodiments, the item or material stored within the storage compartment 104 can be one that requires a low humidity environment. In some embodiments, the item or material stored within the storage compartment 104 can be one that itself has desiccating properties (e.g., acts as a desiccant). In some embodiments, the storage compartment 104 can be configured to hold a roll of material 106 for use with an insulating glazing unit (IGU) assembly. In some embodiments, the roll of material 106 can be a roll of window spacer material (e.g., material configured to be placed between two sheets of glass when forming an insulating glazing unit for use with fenestration units such as windows and doors).

It will be appreciated that while in many embodiments the item to be stored within the low humidity storage device is a roll of window spacer material, other materials can also be stored therein. By way of example, polymer desiccant (such as a barrel or other container of desiccant), beaded desiccant, or other types of desiccants. However, in some embodiments, the material stored within the low humidity storage device may be a non-desiccant. Materials can be disposed in many different types of containers or holders and then placed within the storage compartment. Such containers or holders can include, but are not limited to, reels, winding cores, brackets, boxes, bags, gaylord containers, bins, bottles, tubs, and the like.

In some embodiments, the low humidity storage device 100 may include a gas release valve 132 (or slow release valve). The gas release valve 132 can serve to provide egress for a gas within the low humidity storage device 100 when the pressure inside the low humidity storage device 100 is greater than the ambient pressure, or greater by some threshold amount, in order to allow for turnover of the gas within the low humidity storage device 100. However, in some embodiments, the gas release valve 132 may be omitted and egress of gas can occur through leakage of seals and/or joints in the structure forming the low humidity storage device 100.

Figure 2:
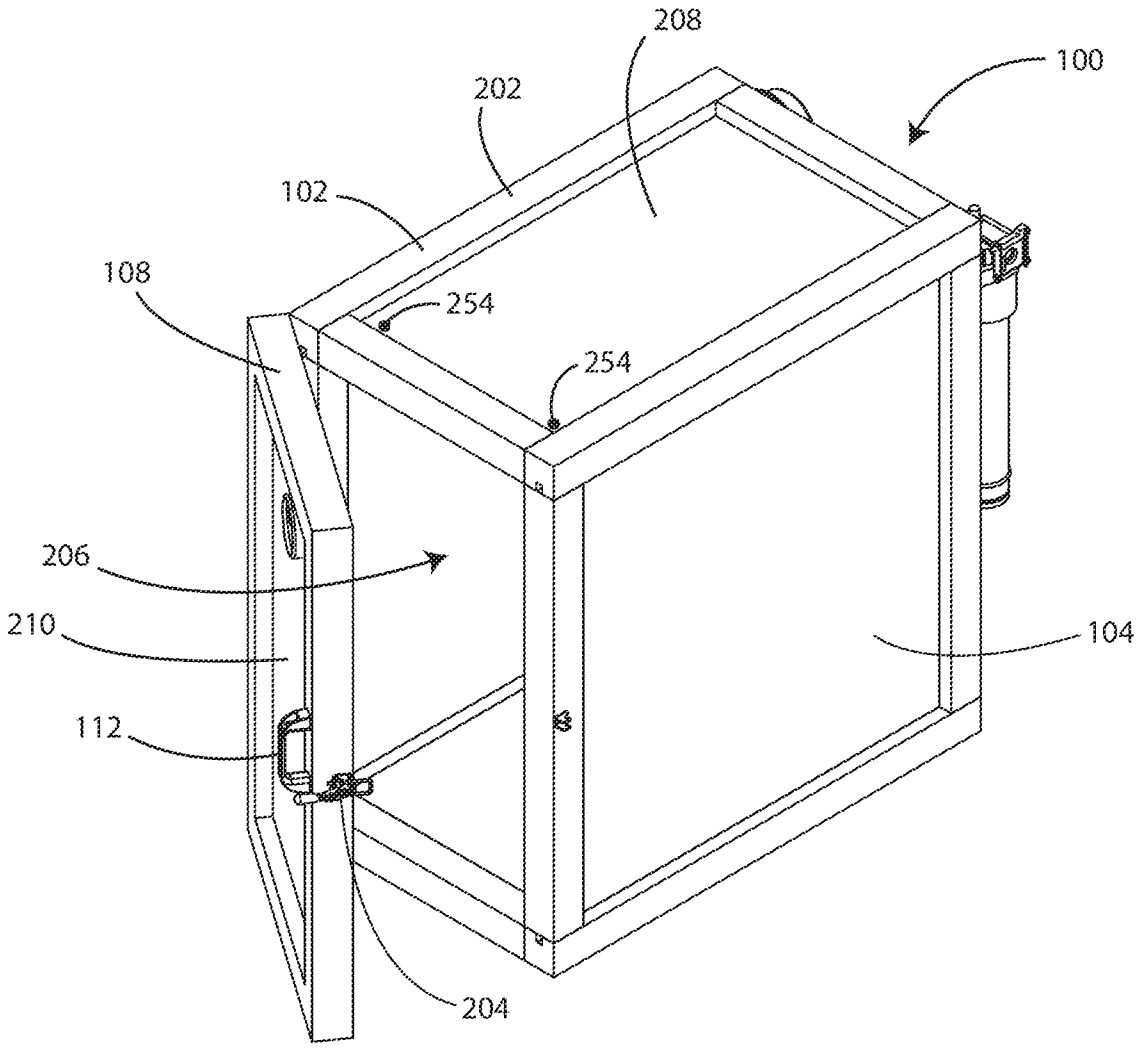
FIG. 2 is a schematic perspective view of a low humidity storage device in accordance with various embodiments herein.

Referring now to FIG. 2, a schematic perspective view is shown of a low humidity storage device 100 in accordance with various embodiments herein. In some embodiments, a latch mechanism 204 can be included on the door 108 and/or on the housing 102 of the low humidity storage device 100. The latch mechanism 204 can be used to keep the door 108 in a closed position and/or to generate a closure force to cause gaskets or other sealing members to be compressed.

The low humidity storage device 100 includes a housing 102 defining the storage compartment 104 and an access aperture 206. The housing 102 can include a frame 202 and one or more panels 208 on different sides of the housing 102. The frame 202 can be made of many different materials, including, but not limited to, metals such as aluminum, stainless steel or other alloys, titanium, ferrous metals, polymers, composites, natural materials, and the like. In some embodiments, at least some of the panels (or portions) can be made of a transparent or translucent material. In some embodiments, at least some of the panels can be made of an opaque material. In some embodiments, the panels can be made of metals, composites, glass, natural materials, or polymers such as polycarbonate, poly(methyl methacrylate) (PLEXIGLAS), polyolefins (such as polyethylene or polypropylene), polystyrene, polyethylene terephthalate (PET), acrylonitrile butadiene styrene (ABS) or the like. In some embodiments, the door 108 can also include a panel 210, which can be a transparent panel or transparent portion. While not intending to be bound by theory, it is believed that the use of one or more transparent panels can be advantageous because then operators can see what is in the storage compartment without opening it and thus triggering a potentially unnecessary purge cycle.

In some embodiments, the low humidity storage device 100 can also include other components, such as one or more pressure relief valves 254. The pressure relief valve 254 can be configured to open and release pressure inside of the storage compartment 104 if the pressure reaches a threshold value above ambient pressure. The threshold value could be 1, 2, 3, 4, 5, 6, 7, 8, 9, 10, or more inches of water. In some embodiments, the low humidity storage device 100 can include a thermometer in order to measure the temperature of the air within the low humidity storage device 100. In some embodiments, the low humidity storage device 100 can include a heating element in order to heat the air within the low humidity storage device 100. In some embodiments, the heating element can be controlled by the control unit 120.

Figure 3:
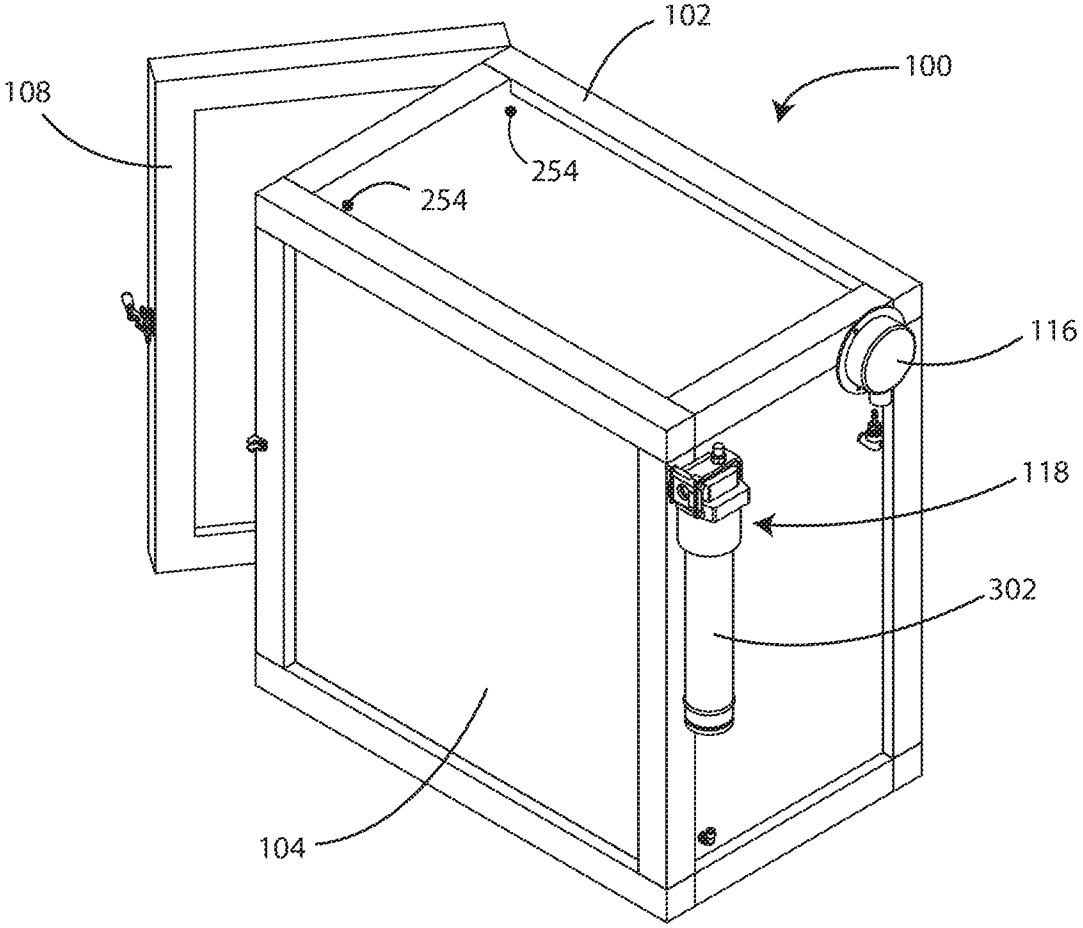
FIG. 3 is a schematic perspective view of a low humidity storage device in accordance with various embodiments herein.

Referring now to FIG. 3, a schematic perspective view is shown of a low humidity storage device 100 in accordance with various embodiments herein. The low humidity storage device 100 includes a housing 102 defining the storage compartment 104. The low humidity storage device 100 can include a door 108 attached to the housing. The low humidity storage device 100 can include a pressure sensor 116 and one or more pressure relief valves 254. The dry gas supply system 118 can include a hollow fiber membrane filter 302. Exemplary hollow fiber membrane filters 302 can include FINITE FMD series filters commercially available from Parker Hannifin Corporation, Cleveland, Ohio. In some embodiments, the dry gas supply system 118 can be connected to a source of dry gas such as a tank or canister filled with a dry gas. The dry gas supply system 118 can be configured to deliver low humidity gas at various rates. In some embodiments, the dry gas supply system 118 can be configured to supply gas at a rate of 0.02 CFM to 0.5 CFM.

Figure 4:
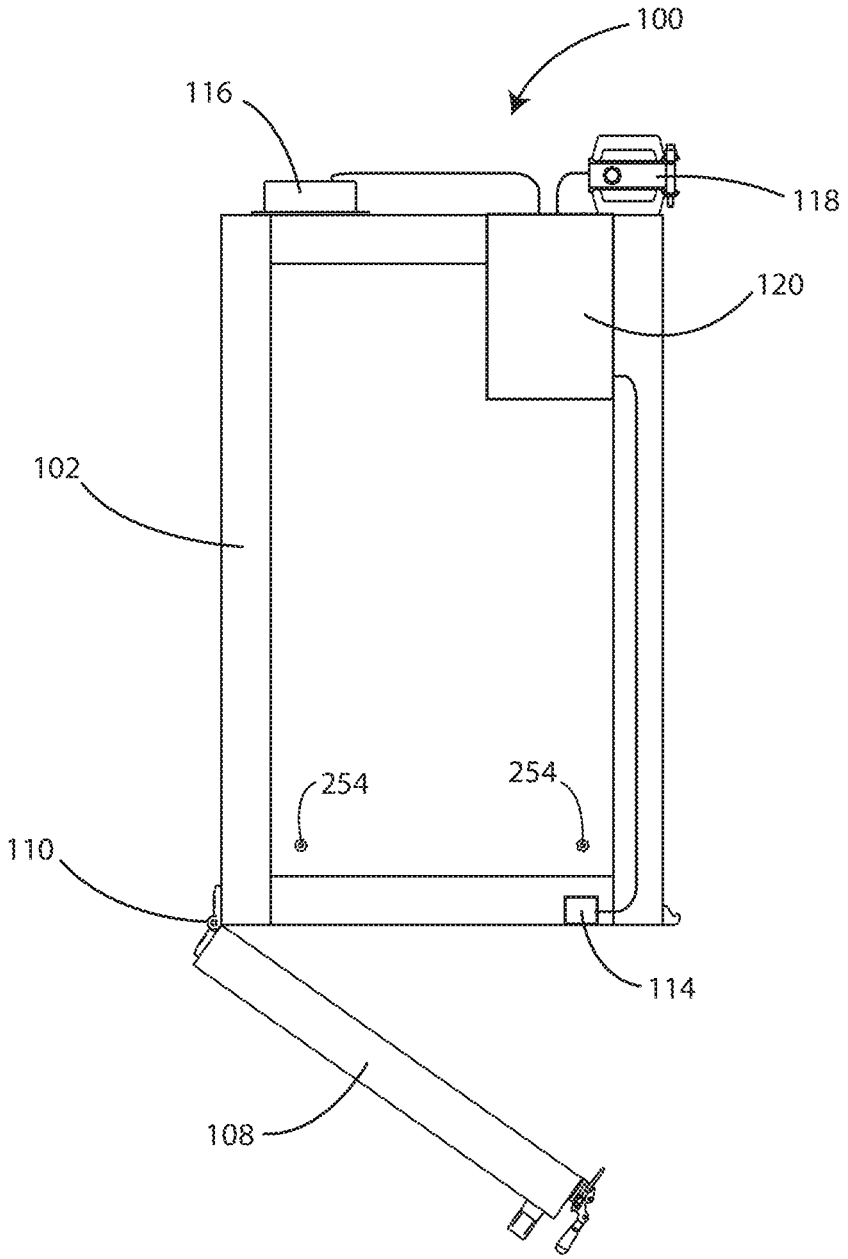
FIG. 4 is a schematic top view of a low humidity storage device in accordance with various embodiments herein.

Referring now to FIG. 4, a schematic top view is shown of a low humidity storage device 100 in accordance with various embodiments herein. The low humidity storage device 100 includes a housing 102 defining the storage compartment 104. The low humidity storage device 100 can include a door 108 attached to the housing via a hinge 110 or similar mechanism. The low humidity storage device 100 can include a dry gas supply system 118, a pressure sensor 116 and one or more pressure relief valves 254. A control unit 120 can control operations of the dry gas supply system 118 and receive data input from various sensors such as a door sensor 114 and a pressure sensor 116, which can determine the difference between pressure inside of the storage compartment 104 and ambient pressure.

Figure 5:
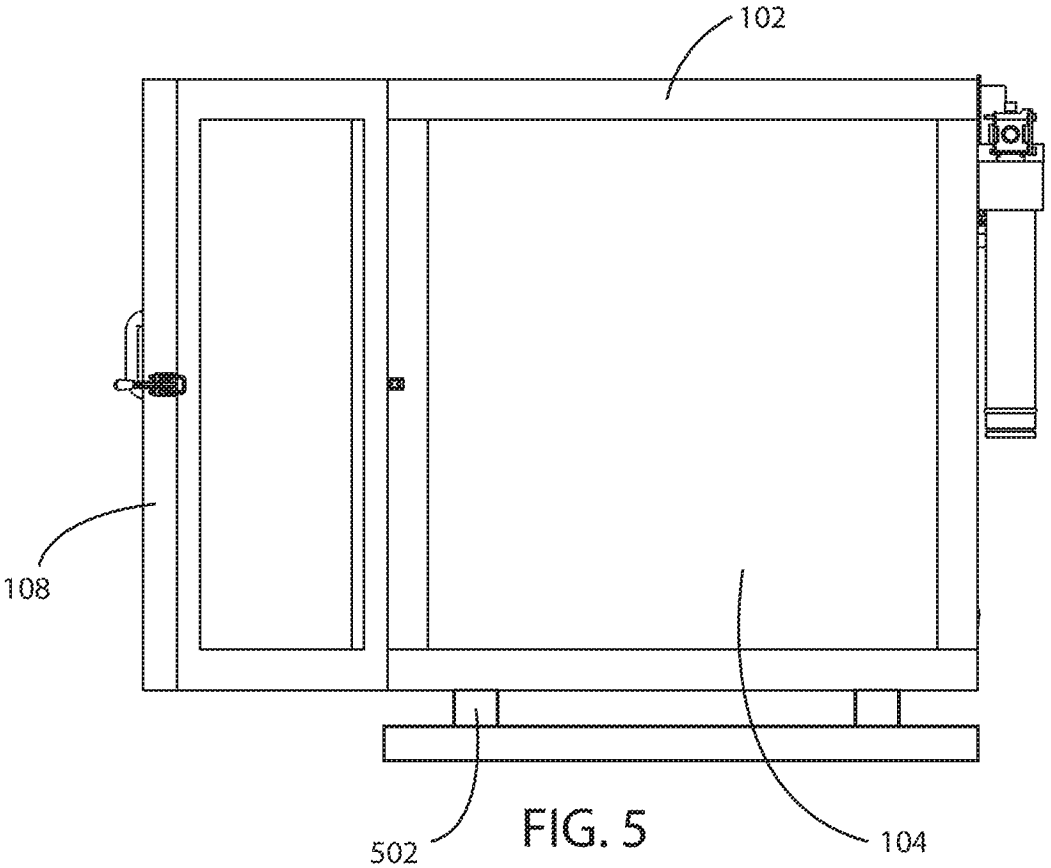
FIG. 5 is a schematic side view of a low humidity storage device in accordance with various embodiments herein.

Referring now to FIG. 5, a schematic side view is shown of a low humidity storage device 100 in accordance with various embodiments herein. The low humidity storage device 100 can include a housing 102 defining a storage compartment 104. The low humidity storage device 100 can also include a door 108 attached to the housing 102. In some embodiments, the low humidity storage device 100 can also include a weight sensor 502, such as a load cell or other type of weight detecting sensor such as various types of pressure sensors. The weight sensor 502 can be sensitive enough to detect whether or not a material (such as a roll of window spacer material) has been placed within the storage compartment 104.

It will be appreciated that embodiments herein can include low humidity storage devices with multiple distinct storage compartments forming an array of storage compartments. In some cases, the distinct storage compartments share one or more components described above such as the control unit 120 and/or a dry gas supply system 118 and the like. However, in other embodiments, each storage compartment has all of its own components that are not shared.

Figure 6:
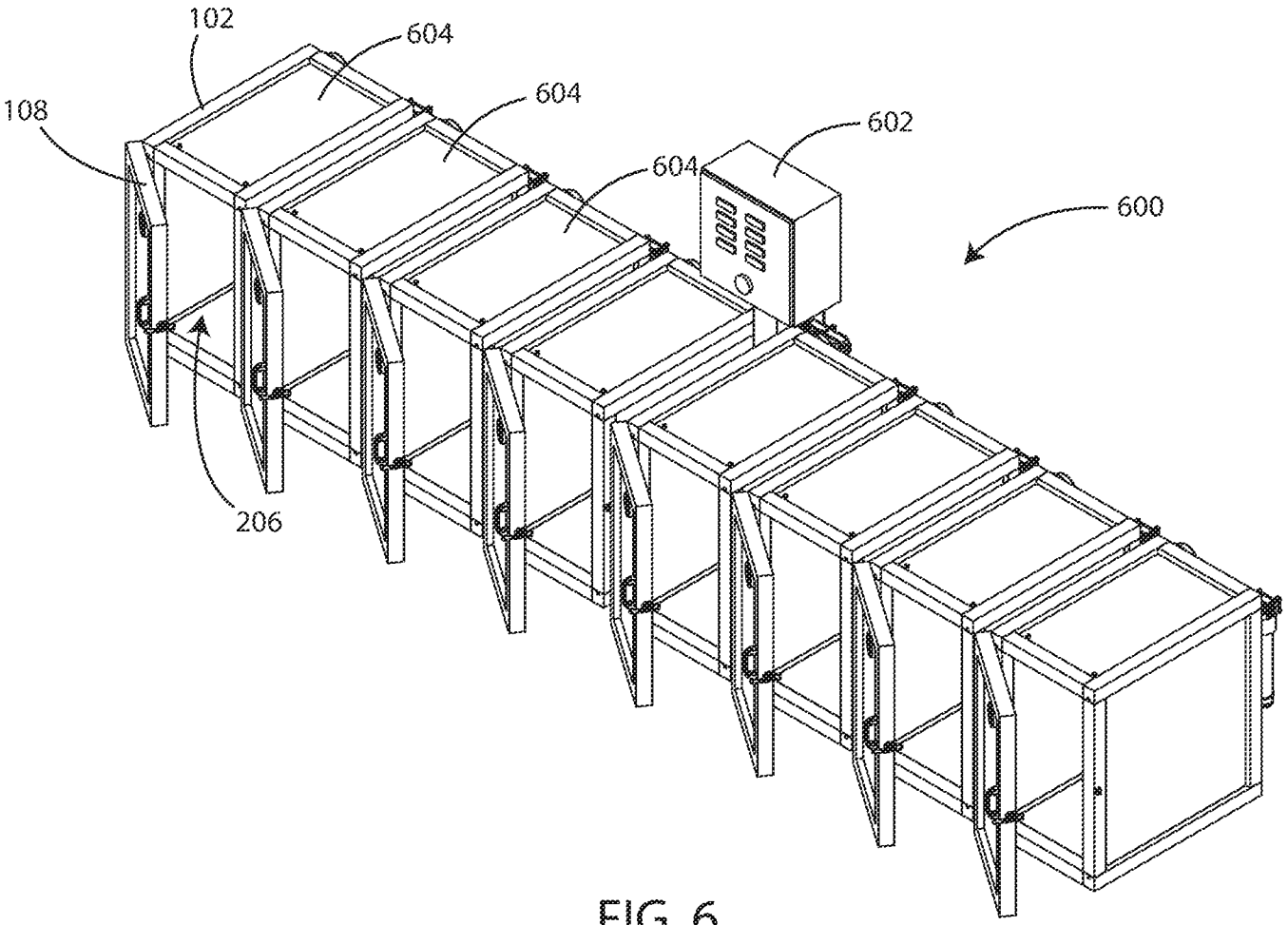
FIG. 6 is a schematic view of a low humidity storage device in accordance with various embodiments herein.

Referring now to FIG. 6, a schematic view is shown of a low humidity storage device 600 in accordance with various embodiments herein. The low humidity storage device 600 can include multiple storage compartments 604. The storage compartments 604 can be defined by a housing 102. Each storage compartment 604 can include a door 108 which can cover an access aperture 206. Operations associated with each storage compartment 604, such as sensor inputs, dry gas supply system operations, and the like can be controlled by a central control unit 602. In some embodiments, the controlled low humidity storage device can include multiple valves, such as solenoid valves, to selectively deliver low humidity gas from a single dry gas supply system to particular storage compartments. In other embodiments, multiple dry gas supply systems can be included, such as one for each storage compartment.

Control Unit and Control Unit Operations

Control units herein can include various elements to execute operations and/or receive inputs and create outputs. Control unit components can include components such as application specific integrated circuits (ASICs), microprocessors, microcontrollers, programmable logic controllers (PLCs), and the like.

Figure 7:
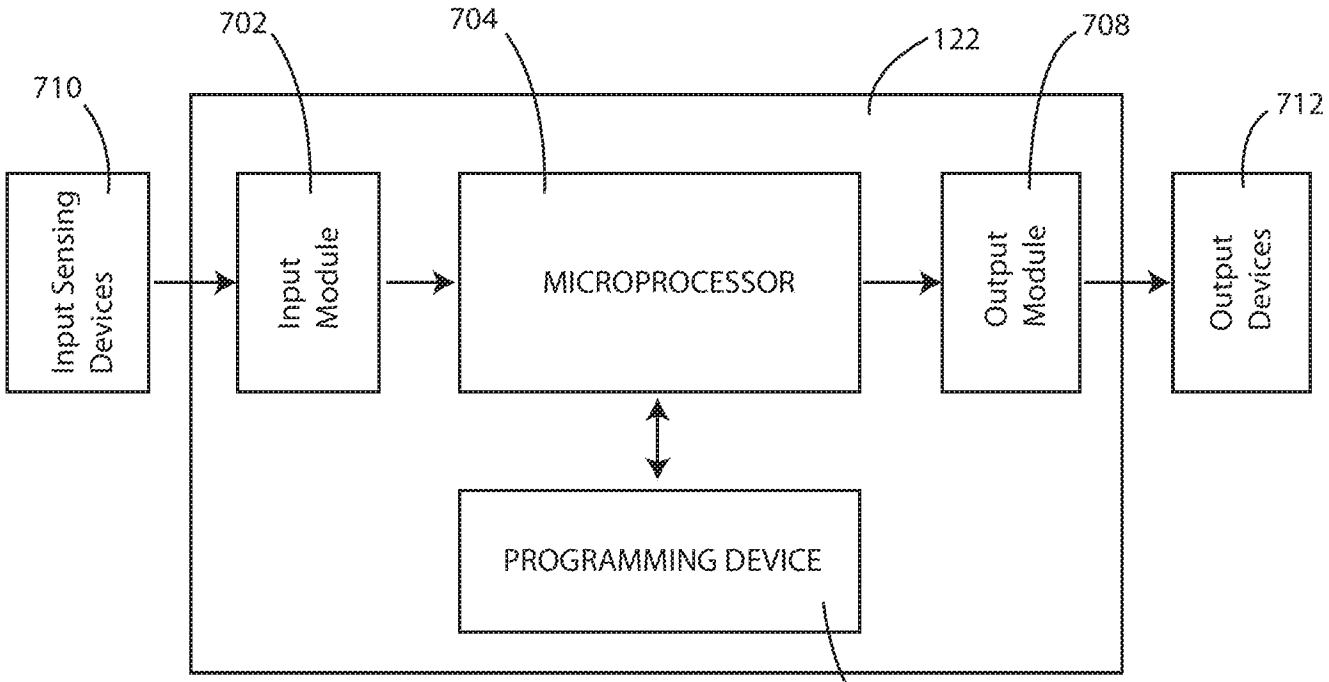
FIG. 7 is a block diagram of elements of a low humidity storage device in accordance with various embodiments herein.

Referring now to FIG. 7, a block diagram is shown of elements of a low humidity storage device in accordance with various embodiments herein. The control unit 120 can include components similar to that of a PLC including an input module 702, a microprocessor 704, a programming device 706, and an output module 708. Various input sensing devices 710 (such as the sensors described above) can provide data to the input module 702. The output module 708 can provide outputs and/or control signals to various output devices 712 (such as solenoids, relays, transistors, motor control circuits, power control circuits, indicators lights, and the like). Exemplary PLCs include those commercially available from Allen Bradley, Siemens, Mitsubishi, Modicon, Arduino, and the like.

The control unit 120 can be configured to execute various operations. In some embodiments, the control unit can be configured to intermittently initiate delivery of low humidity gas from the dry gas supply system to maintain a pressure within the storage compartment that is greater than ambient pressure.

In some embodiments, the control unit 120 can be configured to intermittently initiate delivery of low humidity gas from the dry gas supply system to maintain a pressure within the storage compartment that is at least 1 inch of water greater than the pressure of the ambient environment.

In some embodiments, the control unit 120 can be configured to intermittently initiate delivery of low humidity gas from the dry gas supply system in an amount sufficient to raise the pressure within the storage compartment to a predefined set point that is greater than the pressure of the ambient environment and then cease delivering low humidity gas.

In some embodiments, the control unit 120 can be configured to intermittently initiate delivery of low humidity gas from the dry gas supply system in an amount sufficient to raise the pressure within the storage compartment to at least 1 inch of water greater than the pressure of the ambient environment and then cease delivering low humidity gas. In some embodiments, the cessation of delivering low humidity gas lasts until the pressure within the storage compartment falls to within a predefined amount greater than the pressure of the ambient environment and thereafter the delivery of low humidity gas from the dry gas supply system is initiated again. In some embodiments, the cessation of delivering low humidity gas lasts until the pressure within the storage compartment falls to within 0 to 0.1 inch of water greater than the pressure of the ambient environment and thereafter the delivery of low humidity gas from the dry gas supply system is initiated again.

Figure 8:
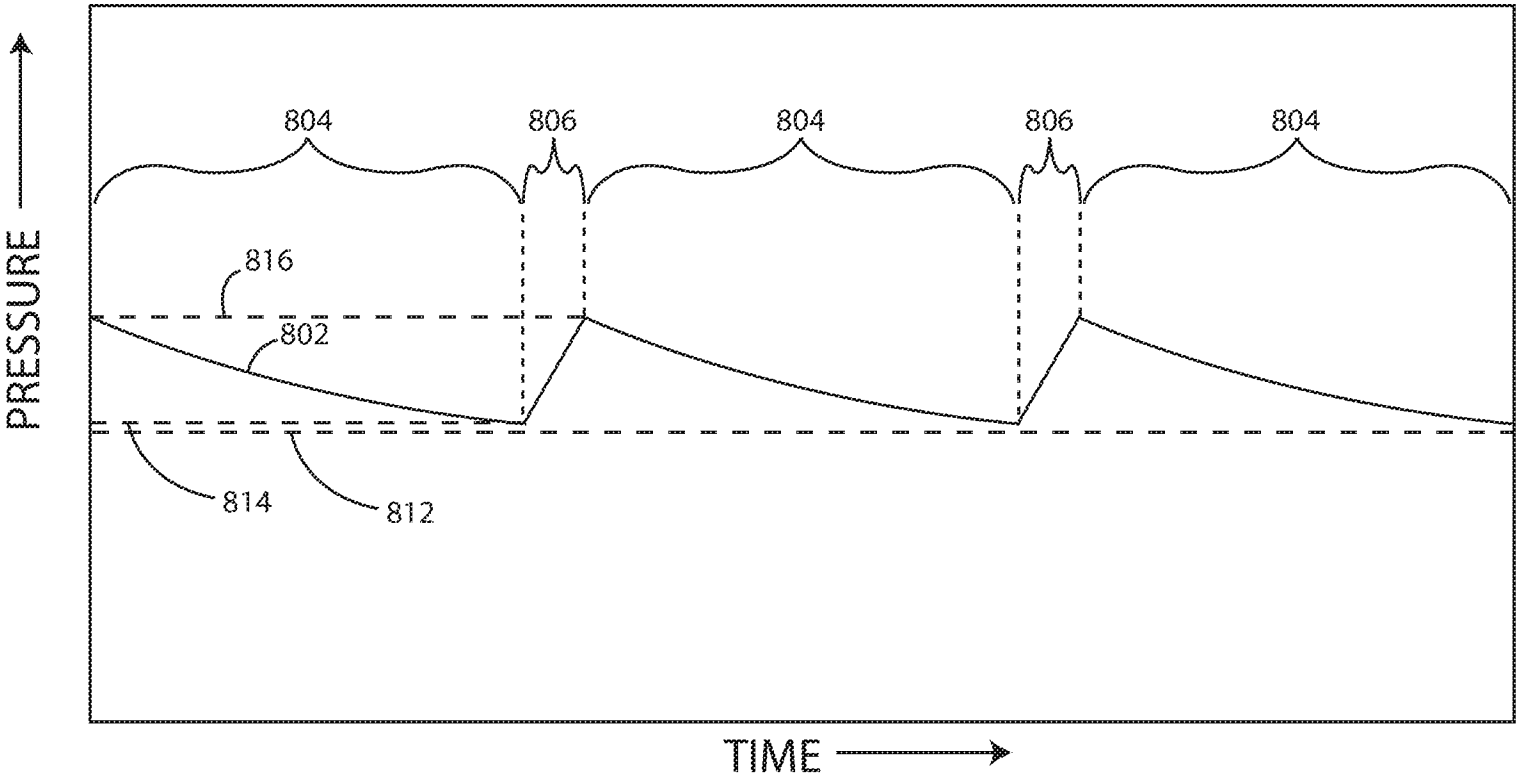
FIG. 8 is a diagram of pressure versus time for a gas within a storage compartment in accordance with various embodiments herein.

Referring now to FIG. 8, a graph is shown illustrating the pressure inside 802 the storage compartment over time. In this view, phase 804 illustrates a scenario where the pressure inside the storage compartment is gradually dropping, such as when the dry gas supply system is not operating and gas is slowly exiting the storage compartment through leakage or a slow release valve. In this example, when the pressure inside 802 hits a certain threshold amount 814 (or low-maintenance threshold), then phase 804 ends and the delivery of low humidity gas from the dry gas supply system is initiated in phase 806 which results in the rapid increase of pressure inside 802 the storage compartment up to a certain threshold amount 816 (or high-maintenance threshold). In this view, phases 804 and 806 are then repeated. These alternating cycles (804, 806) can be referred to as a maintenance mode of operation.

The low-maintenance threshold can be just above ambient pressure 812. In some embodiments, the low-maintenance threshold can be about 0.01, 0.025, 0.05, 0.075, 0.09, 0.1, 0.2, 0.3, 0.4 or 0.5 inches of water, or can fall within a range between any of the foregoing values. The high-maintenance threshold can be sufficiently high enough above ambient pressure 812 so as to prevent the system from having to cycle on and off too frequently. In some embodiments, the high-maintenance threshold is at least about 0.5, 0.75, 1.0, 1.25, 1.5, 2, 3, 4, or 5 inches of water or more, or can fall within a range between any of the foregoing values.

In some embodiments, maintenance mode operation can be interrupted by the door to the storage compartment opening. In some embodiments, the control unit 120 is configured to initially halt the delivery of dry gas from the dry gas supply in response to detecting a dooring opening event and then trigger the dry gas supply to deliver low humidity gas to in an amount sufficient to raise the pressure within the storage compartment to at least a predefined amount greater than the pressure of the ambient environment in response to a detected door closing event, then continue delivering low humidity gas for a predefined period of time. This sequence of events can be referred to as a purge, purge mode, or door-opening mode of operation. Thereafter, the system can reinitiate a maintenance mode of operation.

In some embodiments, the control unit 120 is configured to trigger the dry gas supply to deliver low humidity gas to in an amount sufficient to raise the pressure within the storage compartment to at least 1 inch of water greater than the pressure of the ambient environment in response to a detected door opening and/or closing event, then continue delivering low humidity gas for a predefined period of time, and then cease delivering low humidity gas. In some embodiments, the predefined period of time is calculated from the volume of the box and the gas turnovers in the box to achieve the target humidity within the desired time. In some embodiments, the predefined period of time is about, 1, 2, 3, 4, 5, 8, 12, 15, 20, 25, 30, 45, 60 minutes or more, or can fall within a range between any of the foregoing amounts of time.

In some embodiments, the control unit can interpret a rapid drop in pressure (as measured with a pressure sensor or pressure transducer) as a door opening event. In some embodiments, the control unit interprets a drop in pressure of greater than 0.5 inches of water in less than 5 seconds as a door opening event.

Figure 9:
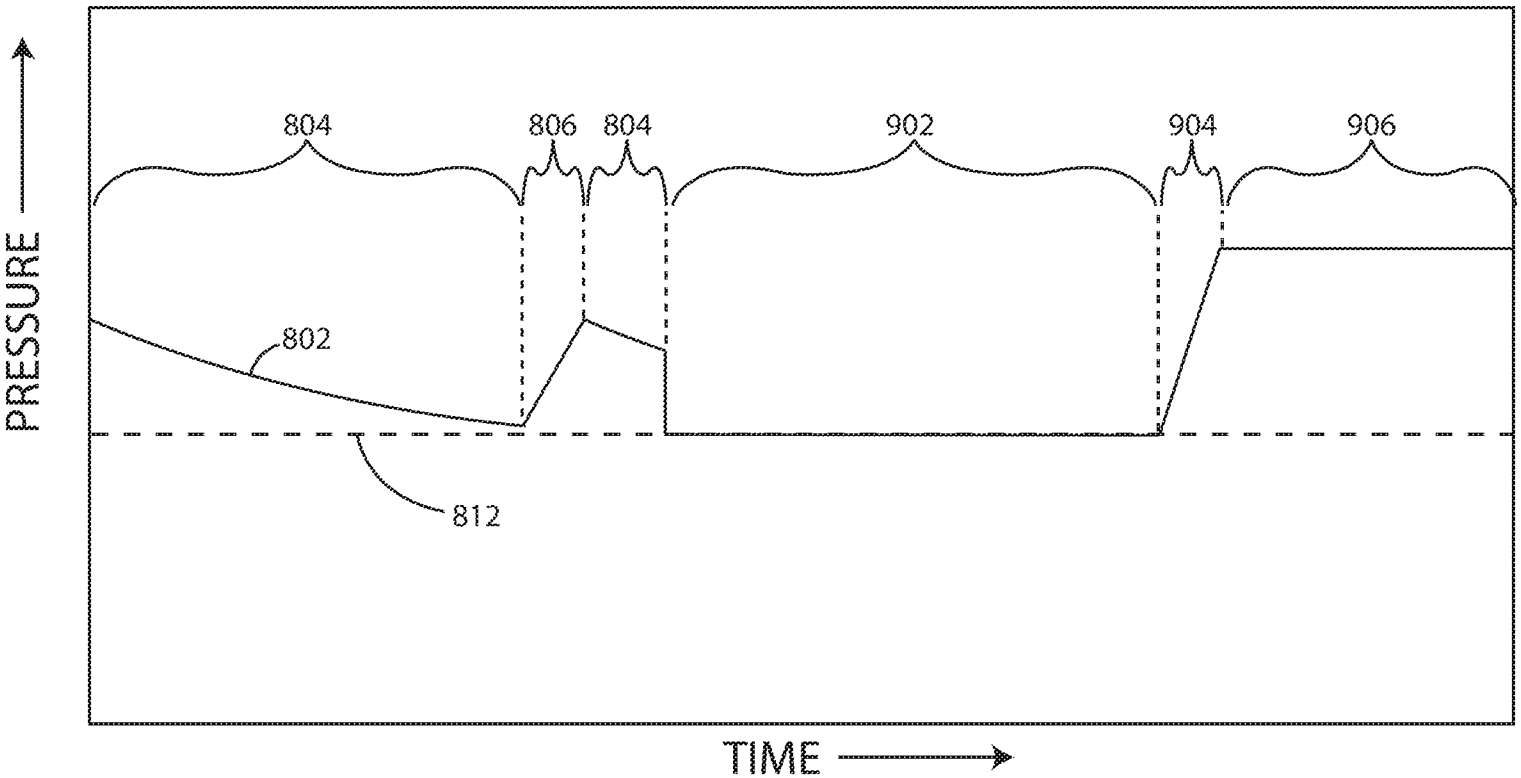
FIG. 9 is a diagram of pressure versus time for a gas within a storage compartment in accordance with various embodiments herein.

Referring now to FIG. 9, a graph is shown illustrating the pressure inside 802 the storage compartment over time. In this view, phase 804 illustrates a scenario where the pressure inside the storage compartment is gradually dropping, such as when the dry gas supply system is not operating and gas is slowly exiting the storage compartment through leakage or a slow release valve. In this example, when the pressure inside 802 hits a certain threshold amount (or low-maintenance threshold), then phase 804 ends and the delivery of low humidity gas from the dry gas supply system is initiated in phase 806 which results in the rapid increase of pressure inside 802 the storage compartment up to a certain threshold amount (or high-maintenance threshold). In this particular example, phase 804 then repeats until a rapid, almost instantaneous drop in pressure down to ambient pressure 812 occurs. This sudden drop is consistent with the door to the storage compartment opening. If such a rapid sudden drop occurred during phase 806, this could trigger the control unit to cause the dry gas supply system to stop delivering a dry gas. Similarly, if a door sensor detected the door opening during phase 806, this could trigger the control unit to cause the dry gas supply system to stop delivering a dry gas. Stopping the delivery of dry gas in these circumstances can allow for more efficient use of relatively expensive compressed air (or "plant air").

Phase 902 represents a hold period (or hold mode of operation) where the door to the system remains open and the pressure inside the storage compartment is equal to ambient pressure 812. Phase 902 can end when the door to the system is closed. In some embodiments, phase 902 can end after a door sensor detects the door being closed. In some embodiments, phase 902 can end after a predefined period of time based on the assumption that the door will be closed by a user (or automatically closed through a spring-loaded mechanism or door actuator) in due course. The predefined period of time can be about 15 seconds, 30 seconds, 1 minute, 2 minutes, 3 minutes, 5 minutes, 10 minutes or longer or can fall within a range between any of the foregoing amounts of time. Phase 904 follows phase 902 and represents the beginning of a first purge phase in which the pressure rapidly climbs to a level above ambient pressure. Phase 904 can last until the start of phase 906 which represents a second purge phase where the egress of gas from the storage compartment matches the ingress of gas from the dry gas supply system and further increases in pressure stop (e.g., the pressure reaches a high purge pressure threshold), but the humidity of the gas within the storage compartment continues to drop as the pre-existing gas in the storage compartment is gradually purged out. In some cases, the egress of gas from the storage compartment can match the ingress of gas from the dry gas supply system based on egress losses of gas through a valve and/or through leakage of gas out through portions of the system that may not be hermetically sealed, such as the interface between the door and the storage compartment. In some embodiments, the humidity of the gas within the storage compartment can follow an exponential decay pattern during the purging phases 904, 906.

Methods

Various methods are included herein. In some embodiments, a method of assembling insulating glazing units is included. The method can include placing a first portion of a spacer between two sheets of a transparent material. The method can further include placing a remaining portion of the spacer into a low humidity storage device. The method can further include removing moisture from the controlled low humidity storage device. The method can further include removing the remaining portion of the spacer from the controlled low humidity storage device. The method can further include placing the remaining portion of the spacer between two sheets of a transparent material.

Figure 10:
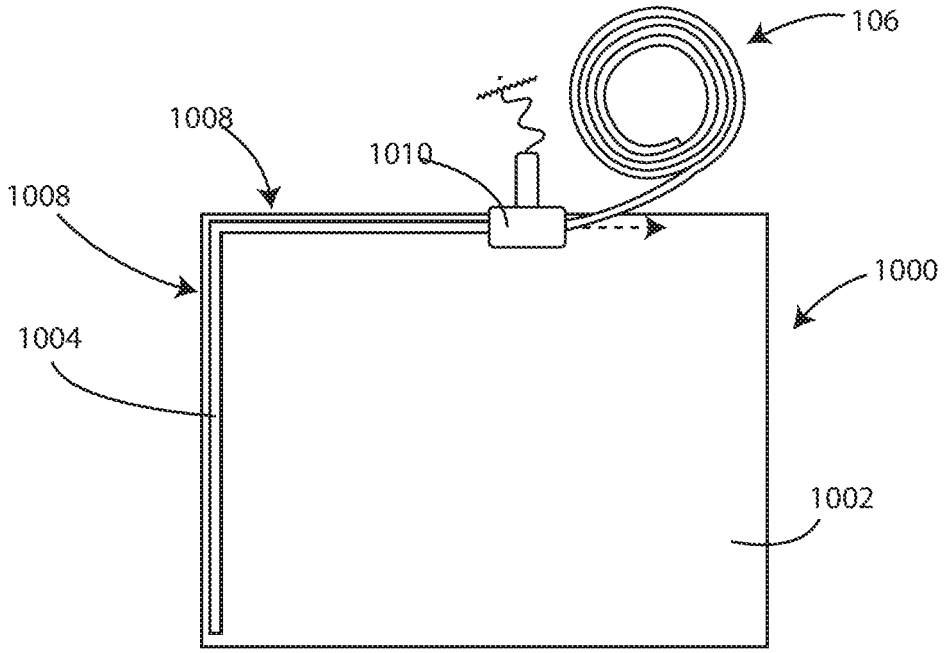
FIG. 10 is a schematic illustration of a portion of a method in accordance with various embodiments herein.

Referring now to FIG. 10, a schematic view of an insulating glazing unit 1000 during assembly is shown in accordance with various embodiments herein. The insulating glazing unit 1000 includes a first sheet of glass 1002. A window spacer assembly 1004 is placed onto the first sheet of glass 1002 adjacent to the peripheral edges 1008 of the first sheet of glass 1002. The window spacer assembly 1004 can be placed onto the first sheet of glass 1002 in various ways. In some examples, a placement device 1010 can be used to assist in the process of placing the window spacer assembly 1004 onto the first sheet of glass 1002. In some cases, the window spacer assembly 1004 can be fed into the placement device 1010 from a roll of material 106. The placement device 1010 can be hand operated or can be automated, such as with an assembly automation system.

Figure 11:
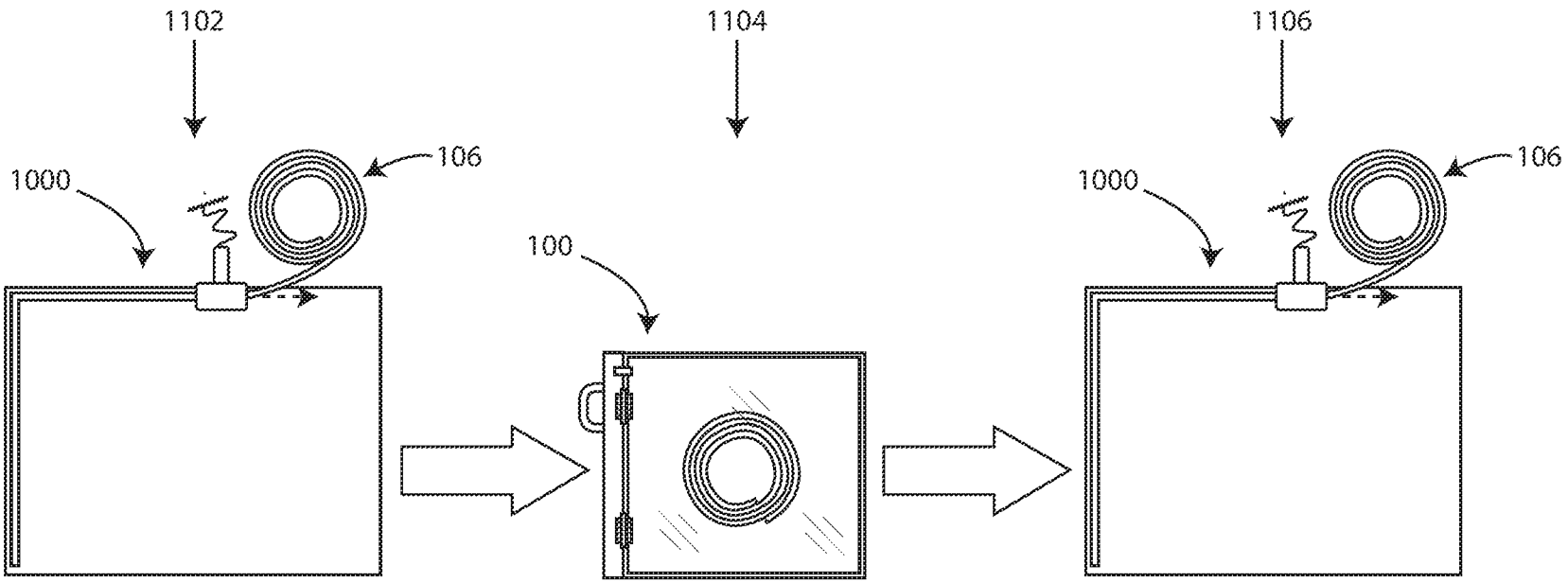
FIG. 11 is a schematic illustration of a method in accordance with various embodiments herein.

At various time points, such as at the end of a production shift, or during change-over of materials used or product manufactured, there may be a left-over amount of material on the roll (or reel) of material 106. In order to maintain the desiccating properties of this material, it is beneficial to store the material in a storage compartment such as those described herein. Referring now to FIG. 11, a sequence of storage compartment use is shown in accordance with various embodiments herein. At phase 1102, roll of material 106 is used in the assembly of insulating glazing units 1000. At phase 1104, the roll of material 106 is then stored in a low humidity storage device 100. At phase 1106, roll of material 106 is removed from the low humidity storage device 100 and again used in the assembly of insulating glazing units 1000.

However, it will be appreciated that embodiments herein can include the use of low humidity storage devices beyond just at end points of operations (such as the end of a shift or the change-over to the use of another material). For example, embodiments herein can include the use of low humidity storage devices for inline manufacturing operations.

EXAMPLES

Example 1: Moisture Content Changes of Flexible Spacer Material Based on Storage Environment A low humidity storage device 100 was constructed consistent with FIG. 2 as described herein. One reel of flexible spacer (SUPER SPACER® brand flexible spacer, commercially available from Quanex Building Products, Houston, Tex.) was stored inside the dehumidification storage container and one reel of flexible spacer was packaged in a MYLAR bag for storage. These spacer reels were left in ambient manufacturing conditions (described below in TABLE 1) for 24 hours and then samples were obtained for moisture content analysis. A control sample was also left out at ambient conditions for 24 hours.

Figure 12:
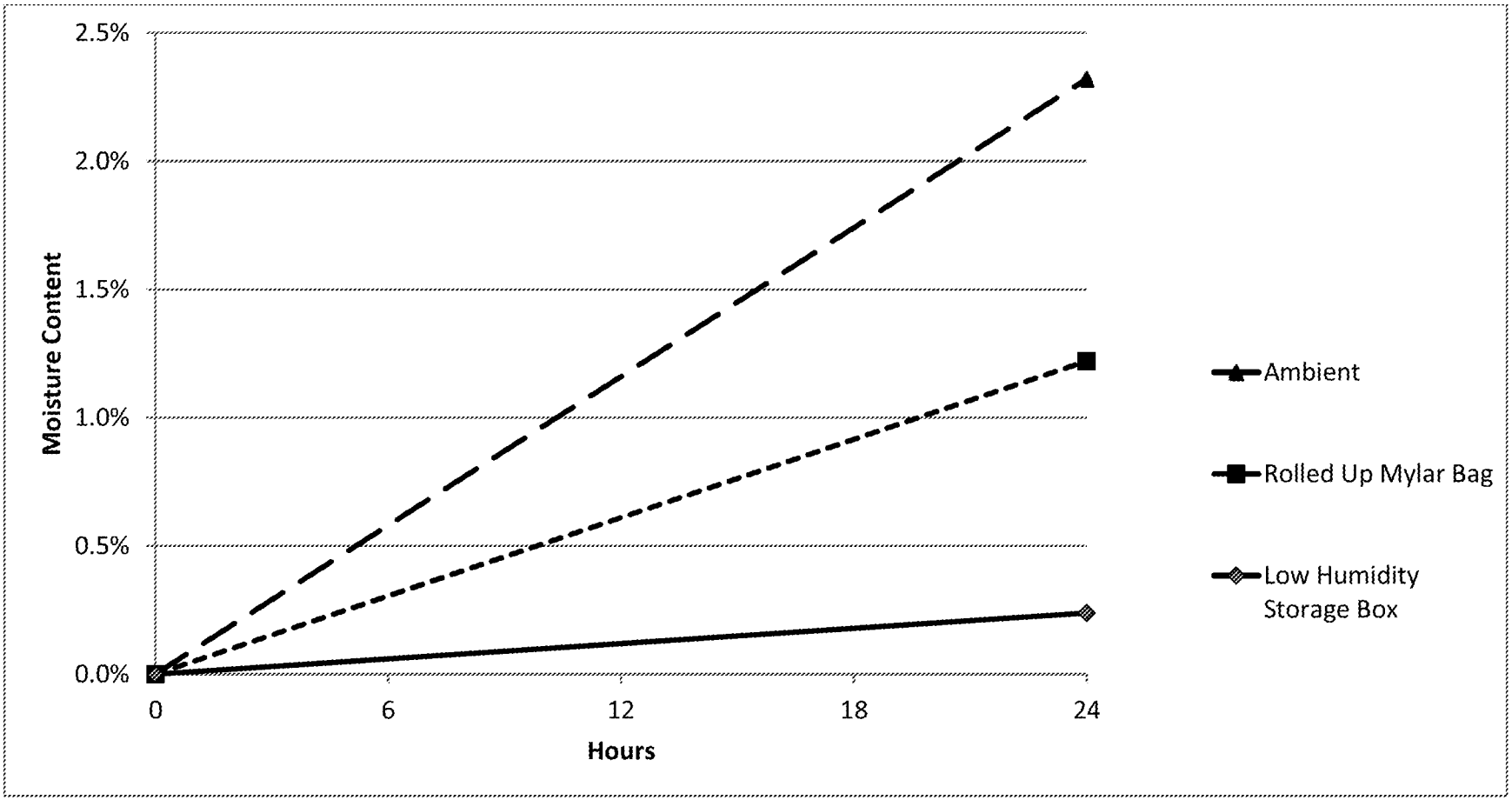
FIG. 12 is chart showing moisture increases over time for a building material component stored under a variety of conditions.
Figure 13:
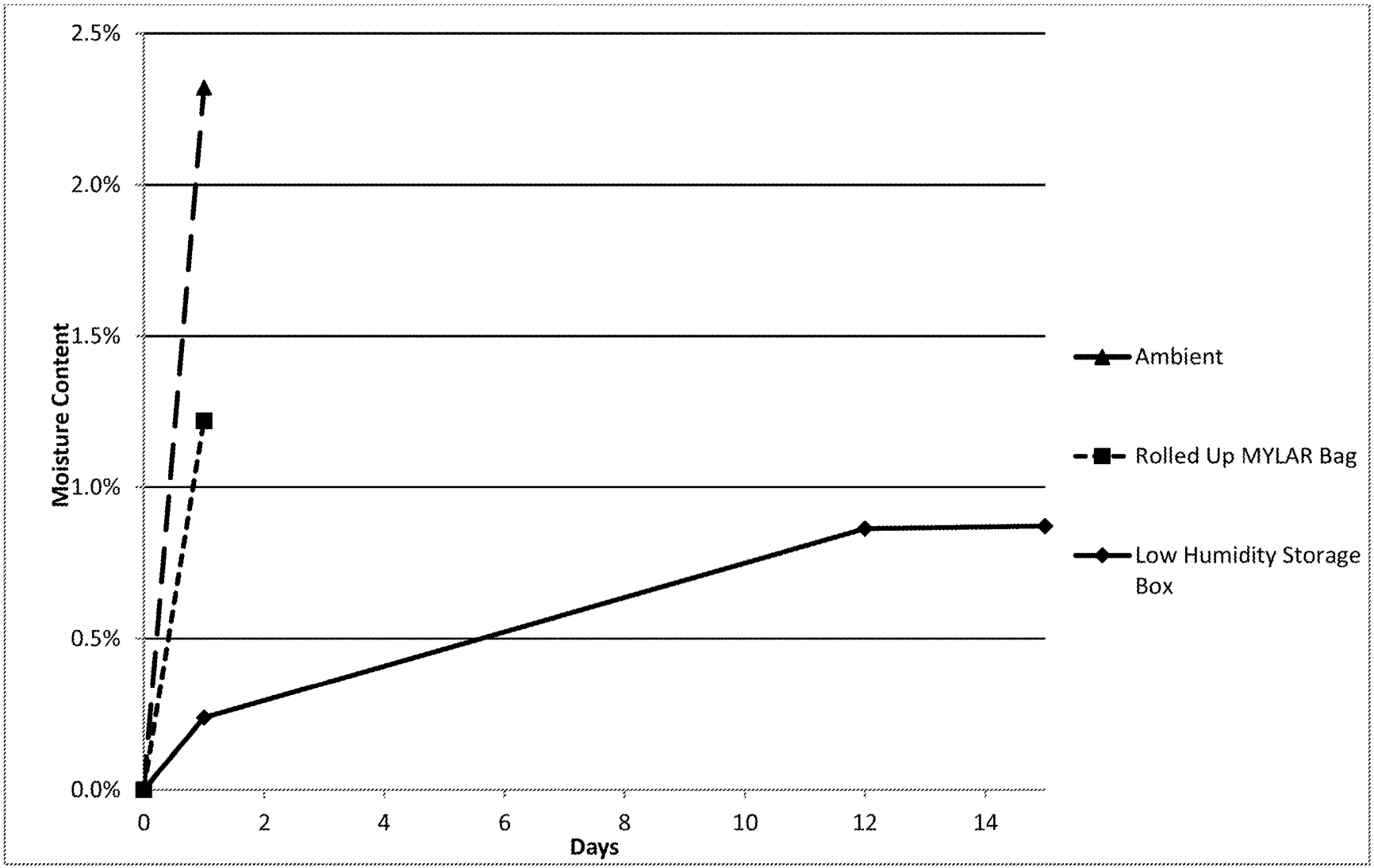
FIG. 13 is chart showing moisture increases over time for a building material component stored under a variety of conditions.

After 24 hours in the dehumidification container the weight of the spacer only increased 0.24% compared to the initial weight. After 24 hours in the repackaged Mylar bag the weight of the spacer increased 1.22% compared to the initial weight. After 24 hours in ambient factory conditions (77° F. and 48% RH) the weight of the spacer increased 2.32% compared to the initial weight. The results are shown below in Table 1 and also in FIGS. 12-13.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein. All publications and patent applications in this specification are indicative of the level of ordinary skill in the art to which this invention pertains.

Aspects have been described with reference to various specific and preferred embodiments and techniques. However, it should be understood that many variations and modifications may be made while remaining within the spirit and scope herein. As such, the embodiments described herein are not intended to be exhaustive or to limit the invention to the precise forms disclosed in the following detailed description. Rather, the embodiments are chosen and described so that others skilled in the art can appreciate and understand the principles and practices.

The invention claimed is:

1. A controlled low humidity storage device comprising:

a housing defining a storage compartment and an access aperture;

a door attached to the housing configured to selectively open to allow access to the storage compartment through the access aperture and close to seal the access aperture;

a dry gas supply system in fluid communication with the storage compartment configured to deliver low humidity gas to the storage compartment;

a control unit in electrical communication with the dry gas supply system; and a pressure sensor configured to measure a pressure differential between the inside of the storage compartment and the ambient environment, the pressure sensor in electronic communication with the control unit;

wherein the control unit is configured to intermittently initiate delivery of low humidity gas from the dry gas

TABLE 1

| Sample ID | Temp | Relative Humidity | Storage Conditions | Initial Weight (g) | Final Weight After Storage (g) | Moisture Uptake (g) | Dry Basis Moisture Content |
|---|---|---|---|---|---|---|---|
| 1-1 | 84° F. | 46% | 24 Hours in Dehumidification Box | 15.624 | 15.661 | 0.037 | 0.24% |
| 2-1 | 84° F. | 46% | 24 Hours in Mylar Bag | 15.557 | 15.747 | 0.190 | 1.22% |
| 3-1 | 77° F. | 48% | 24 Hours at Ambient | 17.399 | 17.802 | 0.404 | 2.32% |
| 1-2 | 77° F. | 48% | 12 Days in Dehumidification Box | 17.154 | 17.302 | 0.148 | 0.86% |
| 1-3 | 80° F. | 46% | 15 Days in Dehumidification Box | 15.973 | 16.113 | 0.139 | 0.87% |

supply system in an amount sufficient to raise the pressure within the storage compartment to at least 1 inch of water greater than the pressure of the ambient environment and then cease delivering low humidity gas.

2. The controlled low humidity storage device of claim 1, the dry gas supply system comprising a hollow fiber membrane filter.

3. The controlled low humidity storage device of claim 1, further comprising a door sensor in electrical communication with the control unit, the door sensor configured to detect opening and closing of the door.

4. The controlled low humidity storage device of claim 3, the control unit configured to cause gas flow from the dry gas supply system to cease when the door sensor detects opening of the door.

5. The controlled low humidity storage device of claim 3, the control unit configured to trigger the dry gas supply to deliver low humidity gas in response to a signal from the door sensor.

6. The controlled low humidity storage device of claim 1, wherein the control unit is configured to intermittently initiate delivery of low humidity gas from the dry gas supply system to maintain a pressure within the storage compartment that is greater than ambient pressure.

7. The controlled low humidity storage device of claim 1, wherein the cessation of delivering low humidity gas lasts until the pressure within the storage compartment falls to within a predefined amount greater than the pressure of the ambient environment and thereafter the delivery of low humidity gas from the dry gas supply system is initiated again.

8. The controlled low humidity storage device of claim 1, wherein the cessation of delivering low humidity gas lasts until the pressure within the storage compartment falls to within 0 to 0.1 inch of water greater than the pressure of the ambient environment and thereafter the delivery of low humidity gas from the dry gas supply system is initiated again.

9. The controlled low humidity storage device of claim 1, wherein the control unit is configured to trigger the dry gas supply to deliver low humidity gas to in an amount sufficient to raise the pressure within the storage compartment to at least a predefined amount greater than the pressure of the ambient environment in response to a detected door opening event, then continue delivering low humidity gas for a predefined period of time, and then cease delivering low humidity gas.

10. The controlled low humidity storage device of claim 1, wherein the control unit is configured to trigger the dry gas supply to deliver low humidity gas to in an amount sufficient to raise the pressure within the storage compartment to at least 1 inch of water greater than the pressure of the ambient environment in response to a detected door opening event, then continue delivering low humidity gas for a predefined period of time, and then cease delivering low humidity gas.

11. The controlled low humidity storage device of claim 1, wherein the control unit interprets a drop in pressure of greater than 0.5 inches of water in less than 5 seconds as a door opening event.

12. The controlled low humidity storage device of claim 9, wherein the predefined period of time is calculated from the volume of the box and the gas turnovers in the box to achieve the target humidity within the desired time.

13. The controlled low humidity storage device of claim 9, wherein the predefined period of time is from 1 minute to 45 minutes.

14. The controlled low humidity storage device of claim 1, wherein the controlled low humidity gas has a humidity of less than 5% RH at 23 degrees Celsius.

15. The controlled low humidity storage device of claim 1, further comprising a weight sensor to detect the weight of the contents of the storage compartment.

16. A controlled low humidity storage device comprising:

a housing defining a storage compartment and an access aperture;

a door attached to the housing configured to selectively open to allow access to the storage compartment through the access aperture and close to seal the access aperture;

a dry gas supply system in fluid communication with the storage compartment configured to deliver low humidity gas to the storage compartment;

a control unit in electrical communication with the dry gas supply system; and a pressure sensor configured to measure a pressure differential between the inside of the storage compartment and the ambient environment, the pressure sensor in electronic communication with the control unit;

wherein the control unit is configured to trigger the dry gas supply to deliver low humidity gas to in an amount sufficient to raise the pressure within the storage compartment to at least a predefined amount greater than the pressure of the ambient environment in response to a detected door opening event, then continue delivering low humidity gas for a predefined period of time, and then cease delivering low humidity gas.

17. A controlled low humidity storage device comprising:

a housing defining a storage compartment and an access aperture;

a door attached to the housing configured to selectively open to allow access to the storage compartment through the access aperture and close to seal the access aperture;

a dry gas supply system in fluid communication with the storage compartment configured to deliver low humidity gas to the storage compartment;

a control unit in electrical communication with the dry gas supply system; and a pressure sensor configured to measure a pressure differential between the inside of the storage compartment and the ambient environment, the pressure sensor in electronic communication with the control unit;

wherein the control unit interprets a drop in pressure of greater than 0.5 inches of water in less than 5 seconds as a door opening event.

* * * * *